US005417895A

United States Patent [19]

Oberth

[11] Patent Number: 5,417,895

[45] Date of Patent: May 23, 1995

[54] BONDING AGENTS FOR HTPB-TYPE SOLID PROPELLANTS

[75] Inventor: Adolf Oberth, Fair Oaks, Calif.

[73] Assignee: Aerojet General Corporation, Sacramento, Calif.

[21] Appl. No.: 473,254

[22] Filed: Jan. 23, 1990

[51] Int. Cl.[6] ..... C06B 21/00

[52] U.S. Cl. ..... 264/3.1; 149/19.1; 149/19.4; 149/19.92

[58] Field of Search ..... 149/19.4, 19.9, 19.92, 149/19.1; 264/3.1

[56] References Cited

U.S. PATENT DOCUMENTS 3,480,488 11/1969 Rudy et al. ..... 149/7
4,043,850 8/1977 Hoffman et al. ..... 149/19.4
4,214,928 7/1980 Consaga ..... 149/19.9
4,493,741 1/1985 Ducote et al. ..... 149/19.4
4,531,989 7/1985 Ducote et al. ..... 149/19.4
4,658,578 4/1987 Shaw ..... 149/19.9
4,776,993 10/1988 Chang et al. ..... 149/19.4
4,915,755 4/1990 Kim ..... 149/19.92

*Primary Examiner*—Edward A. Miller
*Attorney, Agent, or Firm*—Townsend and Townsend Khourie and Crew

[57] ABSTRACT

Solid composite propellants are prepared by combining solid fuel and oxidizer particles, hydroxy-terminated prepolymers, and bonding agents which have polar functional groups to bond to the oxidizer particles and hydroxyl groups converted to isocyanate groups to bond to the binder. These bonding agents replace the non-reacted precursors as well as aziridine-type bonding agents in common use.

33 Claims, No Drawings

BONDING AGENTS FOR HTPB-TYPE SOLID PROPELLANTS

BACKGROUND OF THE INVENTION

1. Field of the Invention

This invention resides in the field of propellant ingredients, and more specifically of bonding agents which allow hydroxy-terminated binders to cohesively interact with filler materials.

2. Brief Description of the Relevant Art

In the solid propellant industry, large quantities of propellant are required to be produced for space booster rockets. In recent years, this requirement of large quantities of propellant has taxed the capacity of state-of-the-art propellant manufacturing facilities.

One way to alleviate the problem is to shorten the batch mixing times required to produce solid propellants. The propellants currently are produced in a two-step process wherein all ingredients, including the liquid binder components (hereinafter referred to as the "prepolymer"), solid oxidizer particles, and bonding agent are mixed together for a period to fully mix the solid particles into the prepolymer. Only after this mixing stage is complete is a diisocyanate curative added to cure the propellant mix. When a hydroxy-terminated prepolymer is used with current polyol-type bonding agents, the first mixing stage is quite lengthy, as hydrogen bonding between the hydroxyl groups of the bonding agent and prepolymer create a viscous mixture. Also, when ammonium perchlorate (AP) is used as the solid oxidizer, chemisorption of the bonding agent to the AP particle surface evolves ammonia, requiring further vacuum mixing to remove the ammonia.

In order to reduce batch mixing times in propellants using AP as oxidizer and hydroxy-terminated prepolymers, aziridine-type bonding agents are sometimes used. The aziridine homopolymerizes to encapsulate the solid particles. This works well on acidic oxidizers such as AP, as the polymerization is acid catalyzed. In "clean" propellants, however, AP is used in combination with other oxidizers, such as $NaNO_3$, which when combusted produce combustion products which neutralize the HCl evolved from AP combustion. $NaNO_3$ is a neutral compound, and aziridines do not homopolymerize on it. As a result, aziridines do not perform well as bonding agents in mixed oxidizer systems.

This leaves the neutral, polyol-type bonding agents discussed above, but which require long batch mixing times. Examples are bis-(cyanoethyl)-dihydroxypropylamine, bis-(hydroxyethyl)-glycolamide, bis-(hydroxyethyl)-lactamide, and bis-(hydroxyethyl) dimethyl hydantoin. These bonding agents have at least one polar moiety which adheres to the surface of the oxidizer particles, while the hydroxyl groups react with the diisocyanate binder curative.

Another problem with the polyol-type bonding agents is that the diisocyanate curative reacts much more quickly with the hydroxyls of polybutadiene-type prepolymers than with the hydroxyls of the bonding agent. As the isocyanate groups are consumed by the reaction with the prepolymer, fewer and fewer are left to react with the bonding agent. The urethane shell around the oxidizer particles is not complete, leading to weak bonding of binder to oxidizer particles. Complete reaction of all binder hydroxyls is undesirable because this causes the binder to become overly cross-linked, increasing the modulus to a value such that the propellant is not useful. One solution to this problem is to pre-terminate (i.e., cap off) some of the binder hydroxyls with a monoisocyanate, thereby limiting the cross-linking of the binder. This however introduces another step in the propellant manufacturing process, which is generally undesirable for practical reasons such as requiring additional quality controls.

SUMMARY OF THE INVENTION

A novel method has now been developed for the preparation of a solid composite, involving the novel use of isocyanate-capped species as bonding agents. These bonding agents have been discovered to be as effective as the commonly used hydroxy-terminated bonding agents despite the difference in reactive moieties between the two.

The bonding agents in accordance with this invention are species containing polar functional groups for affinity toward the oxidizer, as well as isocyanate groups for bonding to the binder matrix. These bonding agents are conveniently formed as the reaction product of a polyol containing these polar functional groups with a polyisocyanate, the latter being used in an amount sufficient to convert substantially all of the hydroxyl groups on the polyol into isocyanate groups, or at least to convert a sufficient number of the hydroxyls to result in a product that will bond to the binder when the composition is cured.

The use of these converted species as bonding agents offers a number of advantages. For example, these species eliminate or substantially lessen the time required for the "dry-mix" stage. Also, they produce efficient binder-to-solid oxidizer bonds without evolution of ammonia. Still further, they do not require the combination of excess curative and partial pre-termination of the prepolymer hydroxyls to ensure their reaction with the curative to an extent sufficient to produce the bonding effect without excessive cross-linking of the binder. A further advantage of this new discovery is that these bonding agents may be added to the propellant batch at any stage in the batch mixing process. In particular, all ingredients, including the novel bonding agents and curative, can now be mixed at once in a common reaction vessel, rather than a two- or three-step mixing process. The fact that the bonding agents can be combined with the curative makes them readily adaptable to continuous mix processes. Also, unlike aziridines, their presence has little if any effect on batch viscosity.

Further features and advantages of the use of these materials as bonding agents will be apparent from the description which follows.

DETAILED DESCRIPTION OF THE INVENTION

The functional groups which characterize the bonding agents used in the practice of the present invention may vary, but will generally be polar groups having affinity for the oxidizer particles. A variety of polar groups meet this description, and will be readily apparent to those skilled in the art. Two of the most common examples are cyano and oxo groups. Preferred polar groups will be those which have a dipole moment of at least about 2.0 debye units.

The number of such polar groups on the bonding agent molecule is not critical and may vary widely. The most common among known bonding agents are those having one or two polar groups, and this number extends likewise to the bonding agents of the present invention.

Polyols suitable for use in preparing the bonding agents may vary widely as well, notably in terms of molecular size and structure. Any polyol containing at least one polar functional group and two or more hydroxyl groups will be suitable. Preferred such polyols will contain from two to three hydroxyl groups per molecule. Common polyols used in forming polyurethanes of various types may be used.

The same is true for the polyisocyanates. These may vary widely, and any of the wide range of compounds known to those skilled in the art of polyurethane chemistry may be used. Particularly preferred polyisocyanates are diisocyanates.

The bonding agents used in the practice of the present invention preferably have no hydroxyl groups at all, thereby eliminating entirely any possibility of hydrogen bonding between prepolymr hydroxyls and bonding agent hydroxyls. This reduces the time required for the dry-mix stage, which requires mixing a viscous fluid binder composition for long periods of time to disperse solids throughout the binder material. Any hydroxyls originally present on the polyol starting material are converted to isocyanate groups, providing an excess of isocyanate groups for allowing reaction with binder hydroxyls.

The polyol and polyisocyanate are generally selected with a view toward controlling the properties of the resulting bonding agent to meet the needs of the propellant formulation in which the bonding agent is intended for use. One of the bonding agent parameters controlled in this manner is its molecular weight. Higher molecular weight compounds have the advantage of being less soluble in the prepolymer, causing them to adhere more readily to the solid particles. The disadvantage however is a higher viscosity. High molecular weight species are formed by polyols and polyisocyanates linking together in alternating manner to form a chain (for example, diols and diisocyanates forming a chain with a linear backbone). Control of the chain length and hence the molecular weight is achieved by increasing the amount of excess of the isocyanate reactant. The minimum molecular weight is achieved with an equivalent ratio of slightly higher than 2:1.

The bonding agent and prepolymer are selected so that the bonding agent is essentially, if not entirely, insoluble in the prepolymer. This will prevent the bonding agent from acting as a curative for the prepolymer. The bonding agent must however be liquid and readily dispersible throughout the prepolymer, so that the bonding agent does not precipitate in the mixture, maintains a high accessibility to the solid propellant particles, and is readily adsorbed onto their surface. The bonding agent must therefore also be of controlled viscosity to permit such dispersion. This is generally achieved by dissolving the bonding agent in a solvent which is readily dispersible throughout the liquid binder. Any common organic solvent which dissolves the bonding agent may be used. Examples are acetone, methyl ethyl ketone, tetrahydrofuran, dimethylphthalate and glycerol triacetate (triacetin). As an alternative, the curative itself may be used as the solvent for the bonding agent. In many cases, it will be advantageous to use a cosolvent system for the bonding agent, to provide a viscosity which facilitates the dispersion.

Within the parameters described above, certain classes of bonding agents are preferred. One such class is defined by the following formula:

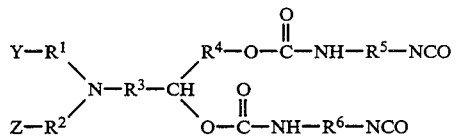

(I)

in which Y and Z are polar moieties; $R^1$, $R^2$, $R^3$ and $R^4$ are $C_1$–$C_6$ alkyl and are either the same or different; and $R^5$ and $R^6$, which may be the same or different, are divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-cyclohexanebismethyl, or nitrazapentane.

Preferred subclasses within Formula I are those in which Y and Z are cyano; those in which $R^1$, $R^2$, $R^3$ and $R^4$ are $C_1$–$C_3$ alkyl; and those in which $R^5$ and $R^6$ are divalent radicals of toluene, isophorone, or nitrazapentane.

A further class are compounds of the formula

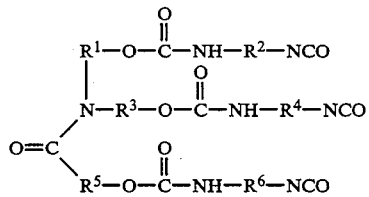

(II)

in which $R^1$, $R^3$ and $R^5$ are the same or different and are each $C_1$–$C_6$ alkylene; and $R^2$, $R^4$, and $R^6$ are are the same or different and are divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-bismethyl-cyclohexanyl, or nitrazapentane.

Preferred subclasses within Formula II are those in which $R^1$, $R^3$ and $R^5$ are $C_1$–$C_3$ alkylene; and those in which $R^2$, $R^4$, and $R^6$ are divalent radicals of toluene, isophorone, or nitrazapentane. Further preferred are those in which $R^1$ and $R^3$ are each $—CH_2CH_2—$, and those in which $R^5$ is $—CH_2—$ or $—CH(CH_3)—$.

A still further class are compounds of the formula

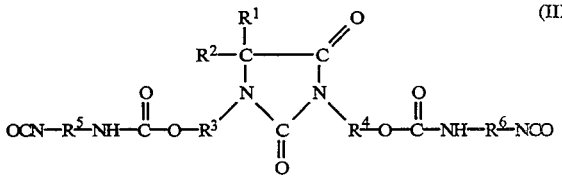

(III)

in which $R^1$ and $R^2$ are $C_1$–$C_6$ alkyl; $R^3$ and $R^4$, which may be the same or different, are $C_1$–$C_6$ alkylene; and $R^5$ and $R^6$ are the same or different and are divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-cyclohexanebismethyl, or nitrazapentane.

Examples of divalent radicals falling within these terms are shown below together with the name of the root compound (in parentheses):

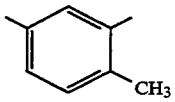
(toluene)

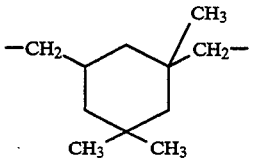
(isophorone)

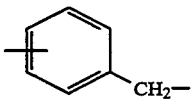
(methyl benzene)

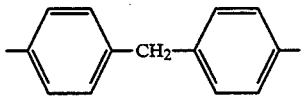
(diphenylmethane)

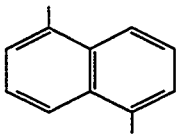
(1,5-naphthalene)

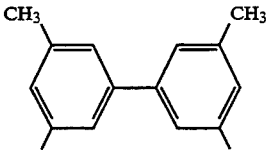
(bitolyl)

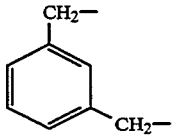
(m-xylene)

$-(CH_2)_6-$ (n-hexane)

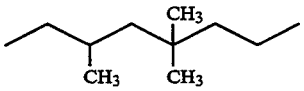
(trimethylhexane)

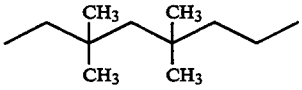
(tetramethylhexane)

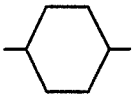
(cyclohexane)

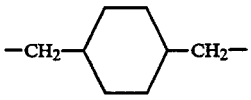
(1,4-bismethylcyclohexane)

-continued

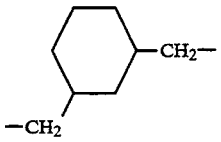
(1,3-bismethylcyclohexane)

$-CH_2CH_2-\underset{\underset{NO_2}{|}}{N}-CH_2CH_2-$ (nitrazapentane)

Preferred subclasses within Formula III are those in which $R^1$ and $R^2$ are $C_1$–$C_3$ alkyl; those in which $R^3$ and $R^4$ are $C_1$–$C_3$ alkylene; and those in which $R^5$ and $R^6$ are divalent radicals of toluene, isophorone or nitrazapentane.

In connection with Formulas I, II and III and throughout this specification and the claims appended hereto, the term "alkyl" is used to denote saturated monovalent hydrocarbyl groups, including both straight- and branched-chain groups. Similarly, the term "alkylene" is used to denote saturated divalent hydrocarbyl groups, including both straight- and branched-chain groups.

Although a wide range of polyols may be used to form the compounds of these formulas, some of the most preferred are bis-(cyanoethyl)-dihydroxypropylamine (commonly known as "C-1"), bis-(hydroxyethyl)-glycolamide (commonly known as "BHEGA"), bis-(hydroxyethyl)-lactamide (commonly known as "BHELA"), and bis-(hydroxyethyl) dimethyl hydantoin (commonly known as "DANTOCOL DHE").

Known diisocyanates which may be used to form the bonding agents include toluene diisocyanate ("TDI"), isophorone diisocyanate ("IPDI"), nitrazapentane diisocyanate ("XIII-diisocyanate"), 1,4-diisocyanatobenzene ("PPDI"), 4,4'-methylenebis(phenyl isocyanate) ("MDI"), 1,5-naphthalene diisocyanate ("NDI"), bitolylene diisocyanate ("TODI"), m-xylylene diisocyanate ("XDI"), 1,6-hexamethylene diisocyanate ("HDI"), 1,6-diisocyanato-2,2,4,4-tetramethylhexane ("TMDI"), 1,6-diisocyanato-2,4,4-trimethylhexane, 1,4-cyclohexanyl diisocyanate ("CHDI"), 1,4-cyclohexanebis(methylene isocyanate) ("BDI"), 1,3-bis(isocyanatomethyl) cyclohexane ("$H_6$XDI"), and methylenebis (cyclohexyl isocyanate) ("$H_{12}$MDI"). Toluene diisocyanate, isophorone diisocyanate, and nitrazapentane diisocyanate are preferred, with toluene diisocyanate particularly preferred due to its low cost.

The method of producing the novel bonding agents of the present invention utilize the commonly known urethane reaction mechanism, whereby a polyol is reacted with a diisocyanate to produce a polyurethane. Procedures and conditions used for the known reaction are suitable here as well.

The temperature and pressure at which the bonding agent is formed are not critical. In most applications, best results are obtained by using enough solvent to contain the slight exothermic heat evolved in the reaction, thereby controlling the temperature to a point below the boiling point of the solvent. The reaction will generally proceed well at moderate pressures and moderate degrees of vacuum.

Typical solvents used in the procedure include acetone, methyl ethyl ketone, and tetrahydrofuran. In general, any solvent in which the polyol and diisocyanate are significantly soluble, which can be used in such a fashion to control the temperature of the reaction, and is inert with respect to the reactants and the bonding agent product may be used. The diisocyanate and polyol should be at least 75 percent by weight soluble in the solvent. A preferred method is to perform the reaction in a polar plasticizer in which the product bonding agent is at least 75 percent soluble, forming a bonding agent composition. Examples of some polar plasticizers are dimethylphthalate and triacetin.

A particularly preferred solvent is one which also functions as a curative for the prepolymer. A bonding agent composition consisting of a bonding agent and curative may then be formed. An example of a curative is isophorone diisocyanate, although other diisocyanate curatives which do not cure the prepolymer too quickly may be used.

The bonding agents of the present invention are useful as ingredients in a wide range of solid composite propellants. Explosive compositions currently used as propellants have various ingredients including a functionally terminated prepolymer, curatives, metallic fuels, various oxidizers (both inorganic and organic), a bonding agent, and other ingredients for processability. Preferred for the purposes of this invention are compositions containing from about 4 to about 25 weight percent of a hydroxy-terminated prepolymer; about 0.2 to about 3 weight percent of a diisocyanate curative (preferably about 0.4% to about 2.0%); about 15 to about 25 weight percent of a metallic fuel; about 25 to about 75 weight percent of an oxidizer; and about 0.1 to about 1.0 weight percent of an isocyanate-capped bonding agent. Further preferred are compositions containing from about 4 to about 25 weight percent of a hydroxy-terminated prepolymer (preferably about 8% to about 15%); about 0.2 to about 3 weight percent of a diisocyanate curative (preferably about 0.4% to about 2.0%); about 15 to about 25 weight percent of a metallic fuel; about 25 to about 35 weight percent of an oxidizer having as combustion products at least one compound capable of neutralizing HCl; about 35 to about 45 weight percent of an oxidizer which produces HCl upon combustion; and about 0.1 to about 1.0 weight percent of an isocyanate-terminated bonding agent. Particularly preferred are compositions which utilize a hydroxy-terminated polybutadiene as the prepolymer; isophorone diisocyanate as the curative; aluminum powder as the metallic fuel; sodium nitrate as the oxidizer which produces a combustion product having the ability to neutralize HCl; ammonium perchlorate as the oxidizer which produces HCl; and an isocyanate-capped bonding agent in accordance with Formulas I, II or III above.

Preparation of the solid composite propellants in accordance with this invention is achieved by first forming a slurry by combining the solid particles of fuel and oxidizer with liquid prepolymer, the bonding agent being dispersed in the prepolymer. The slurry is then cast into the desired shape, which will vary depending on its intended use, and the cast slurry is then cured to form the solid composite propellant. Depending upon the curative used, the curative may also be mixed in as part of the slurry.

In preferred embodiments of the invention, the bonding agent comprises from about 0 1% to about 10% preferably from about 0.2% to about. 0.5%. In further preferred embodiments, as indicated above, the bonding agent is used in the form of a solution in a polar organic solvent readily miscible with the prepolymer or dispersible throughout the prepolymer as a fine emulsion, the solvent preferably being the curative used to cure the prepolymer or a combination of the curative with a viscosity-modifying cosolvent. In most cases, the bonding agent will comprise from about 20% to about 80% of this solution, preferably from about 25% to about 50%.

The following examples are for illustrative purposes and are intended neither too limit nor define the invention in any manner.

EXAMPLE 1

Preparation of Bonding Agents

This example demonstrates the preparation of various bonding agents for use within the scope of the present invention.

A. C-1/TDI—1:2 Mole Ratio

A reaction flask was charged with C-1 (197 g, 1 mole) dissolved in 548 g of dry acetone, and TDI (348 g, 2 moles) was added rapidly with stirring. An initial turbidity disappeared after a few minutes of stirring. The ensuing reaction exhibited a mild exotherm which did not require external cooling. The reaction was complete within a few hours. The product has the structure of Formula I in which Y and Z are each —CN, $R^1$ and $R^2$ are each —$CH_2CH_2$—, $R^3$ and $R^4$ are each —$CH_2$—, and $R^5$ and $R^6$ are each

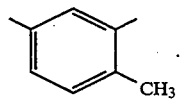

B. C-1/TDI—Mole Ratios Greater than 1:2

The reaction described above was repeated at mole ratios of 1:1.6, 1:1.4, 1:1.2 and 1:1.1. Each reaction yielded a clear solution in acetone.

C. BHEGA/TDI—1:3 Mole Ratio

A reaction flask was charged with BHEGA (165 g, 1 mole) dispersed in 677 g of acetone, and TDI (522 g, 3 moles) was added rapidly with stirring. The solution became clear and homogeneous after about 10 to 15 minutes of stirring. The product demonstrated only slight solubility in cold acetone, but dissolved fully upon warming. This product has the structure of Formula II in which $R^1$ and $R^3$ are each —$CH_2CH_2$—, $R^5$ is —$CH_2$—, and $R^2$, $R^4$ and $R^6$ are each

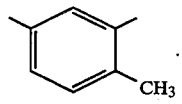

D. BHELA/TDI—1:3 Mole Ratio

A reaction flask was charged with BHELA (177 g, 1 mole) dissolved in 700 g of acetone, and TDI (522 g, 3 moles) was added rapidly with stirring. The solution became clear after a few minutes of stirring, and the product demonstrated solubility in cold acetone. This product has the structure of Formula II in which $R^1$ and $R^3$ are each —$CH_2CH_2$—, $R^5$ is $CH(CH_3)$—, and $R^2$, $R^4$ and $R^6$ are each

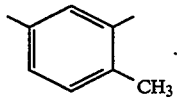

E. DANTOCOL/TDI—1:2 Mole Ratio

A reaction flask was charged with DANTOCOL DHE (216 g, 1 mole) dissolved in 564 g of dry acetone, and TDI (348 g, 2 moles) was added rapidly with stirring. No turbidity was encountered; a clear solution was obtained. This product has the structure of Formula III in which $R^1$ and $R^2$ are each methyl groups, $R^3$ and $R^4$ are each $—CH_2CH_2—$, and $R^5$ and $R^6$ are each

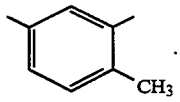

F. C-1/IPDI—1:2 Mole Ratio

A reaction flask was charged with C-1 (197 g, 1 mole) dissolved in 650 g of acetone, and IPDI (452 g, 2 moles) was added with stirring. Stirring was continued for 48 hours at a gentle reflux (approximately 58° C.). After a few hours, the solution became clear and remained so. The product has the structure of Formula I in which $R^1$ and $R^2$ are each $—CH_2CH_2—$, $R^3$ and $R^4$ are each $—CH_2—$, and $R^5$ and $R^6$ are each

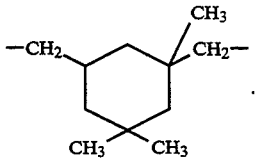

G. DANTOCOL/IPDI—1:2 Mole Ratio

A reaction flask was charged with DANTOCOL DHE (216 g, 1 mole) dissolved in 668 g of acetone, and IPDI (452 g, 2 moles) was added with stirring. Stirring was continued for 48 hours at a gentle reflux (approximately 58° C.). After a few hours, the solution became clear and remained so. This product has the structure of Formula III in which $R^1$ and $R^2$ are each methyl groups, $R^3$ and $R^4$ are each $—CH_2CH_2—$, and $R^5$ and $R^6$ are each

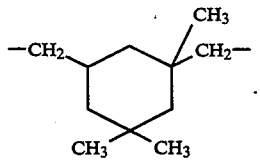

H. C-1/XIII-Diisocyanate—1:2 Mole Ratio

A reaction flask was charged with C-1 (197 g, 1 mole) dissolved in 600 g of acetone, and XIII-diisocyanate (400 g, 2 moles) was added rapidly with stirring. No turbidity was encountered; a clear solution was obtained and allowed to stand for several days at room temperature before use. This product has the structure of Formula I in which $R^1$ and $R^2$ are each $—CH_2CH_2—$, $R^3$ and $R^4$ are each $—CH_2—$, and $R^5$ and $R^6$ are each $—CH_2CH_2—N(NO_2)—CH_2CH_2—$.

EXAMPLE 2

Formulation and Testing of Composite Propellants

Five composite propellants were prepared using as a binder R45AS/IPDI (R45AS is a hydroxyl-terminated polybutadiene, available from ARCO Chemical Co., Philadelphia, Pa.) in which 25 equivalent % of the hydroxyl groups had been prereacted with phenylisocyanate. The composition was 88% solids by weight, with the binder comprising the remaining 11.8%. The solids in each case were aluminum powder at 19% by weight, sodium nitrate at 29% by weight, and ammonium perchlorate=at 40% by weight. The bonding agent varied with each propellant, but in each case was formed from a 1:2 mole ratio of polyol to diisocyanate in acetone, and amounted to 0.2% by weight.

The mechanical properties of the resulting composite propellants are listed in Table I in which "stress" is the maximum engineering stress, "strain" is the elongation at the maximum engineering stress, and "modulus" is the initial tangent modulus. The first entry in the table is a control experiment using a common plasticizer in place of the bonding agent, although in the same amount as the bonding agent.

TABLE I

TEST RESULTS

| Plasticizer or Bonding Agent | Mechanical Properties at 25° C. | | |
|---|---|---|---|
| | Stress (psi) | Strain (%) | Modulus (psi) |
| Dioctyl-azelate | 70 | 27 | 534 |
| C-1/TDI | 144 | 28 | 760 |
| BHELA/TDI | 133 | 27 | 910 |
| BHEGA/TDI | 125 | 28 | 940 |
| DANTOCOL/TDI | 110 | 29 | 690 |

These examples demonstrate the ability of the bonding agents of the present invention to increase the mechanical strength of the propellant.

EXAMPLE 3

Comparison with Aziridine-type Bonding Agents

Seven more composite propellants were prepared using the same solids and binder as in Example 2, although with a slightly different particle size distribution in the solids blend. The control was included as in Example 2, and two of the compositions contained as the bonding agents the aziridine-type compounds HX-752 (iso-phthaloyl-bis[methylethylene imide]) and MAPO (tris[1-(2-methyl)-aziridinyl]phosphine oxide), both of which are outside the scope of this invention. The remainder of the compositions used bonding agents within the scope of the invention. Two of these further contained small amounts of the polyol used to prepare the bonding agents. The mechanical properties are listed in Table II.

TABLE II

TEST RESULTS

| Plasticizer or Bonding Agent | Mechanical Properties at 25° C. | | |
|---|---|---|---|
| | Stress (psi) | Strain (%) | Modulus (psi) |
| 0.2% Dioctyl-adipate | 80 | 21 | 536 |
| 0.2% HX-752 | 96 | 24 | 551 |
| 0.1% MAPO | 121 | 26 | 717 |
| 0.2% BHELA/TDI | 186 | 20 | 1360 |
| 0.175% BHELA/TDI | 210 | 22 | 1330 |

TABLE II-continued

| TEST RESULTS | | | |
|---|---|---|---|
| Plasticizer or Bonding Agent | Mechanical Properties at 25° C. | | |
| | Stress (psi) | Strain (%) | Modulus (psi) |
| plus 0.025% BHELA | | | |
| 0.2% C-1/TDI | 153 | 25 | 949 |
| 0.167% C-1/TDI plus 0.033% C-1 | 156 | 28 | 930 |

The improvement over the aziridine bonding agents is amply demonstrated.

EXAMPLE 4

Formulalation and Testing without Precapping of Binder

The following eleven compositions were prepared using 88% solids in R45AS/IPDI binder. The NCO-/OH ratio was individually adjusted for each composition to optimize mechanical properties, and the prepolymers did not include a preterminated portion as before. The solids were aluminum powder and ammonium perchlorate only, allowing for a better particle size distribution, which was largely responsible for the improved mechanical properties.

The results are listed in Table III, where the equivalent percent IPDI is included.

TABLE III

| TEST RESULTS | | | | |
|---|---|---|---|---|
| Bonding Agent (all at 0.2%) | Equiv. % IPDI | Mechanical Properties at 25° C. | | |
| | | Stress (psi) | Strain (%) | Modulus (psi) |
| None (control) | 68 | 66 | 33 | 357 |
| C-1/TDI 1:2 in acetone | 63 | 145 | 35 | 619 |
| C-1/TDI 1:1.6 in acetone | 64 | 153 | 33 | 650 |
| C-1/TDI 1:1.6 in acetone | 66 | 138 | 35 | 595 |
| C-1/TDI 1:1.2 in acetone | 67 | 161 | 32 | 654 |
| C-1/TDI 1:1.1 in acetone | 68 | 129 | 37 | 515 |
| C-1/TDI 1:2 in dimethylphthalate | 64 | 173 | 29 | 712 |
| C-1/TDI 1:2 in triacetin | 64 | 151 | 31 | 550 |
| C-1/TDI 1:2 in IPDI | 64 | 172 | 36 | 812 |
| C-1/IPDI 1:2 in acetone | 68 | 131 | 29 | 1100 |
| C-1/XIII-diisocyanate 1:2 in acetone | 68 | 101 | 31 | 460 |

The effectiveness of the bonding agents and their ability to function fully without pretermination of a portion of the binder hydroxyls is amply demonstrated.

The foregoing is offered primarily for purposes of illustration. It will be readily apparent to those skilled in the art that further variations, modifications and substitutions may be made in terms of the substances used as well as the procedures, without departing from the spirit and scope of the invention.

What is claimed is:

1. A method for the preparation of a solid composite propellant, said method comprising:

(a) forming a slurry by combining solid particles of fuel and oxidizer with a liquid binder phase, said liquid binder phase comprising a prepolymer and curative having dispersed therein a liquid bonding agent, said bonding agent being insoluble in said liquid binder and comprising the reaction product of a polyol and a polyisocyanate, said polyol containing polar functional groups having affinity for said oxidizer substance, and said polyisocyanate being in excess of said polyol, thereby reacting all hydroxyls thereof and leaving unreacted isocyanate groups on said reaction product;

(b) casting said slurry into a desired shape; and (c) curing said slurry so cast to form a solid composite propellant.

2. A method in accordance with claim 1 in which said curative is a diisocyanate curative.

3. A method in accordance with claim 1 in which said polyisocyanate is a diisocyanate.

4. A method in accordance with claim 1 in which said bonding agent comprises from about 0.1% to about 1.0% of said slurry.

5. A method in accordance with claim 1 in which said liquid binder phase comprises a mixture of liquid binder and a solution of said bonding agent in a solvent miscible with said liquid binder.

6. A method in accordance with claim 5 in which said bonding agent comprises from about 20% to about 80% by weight of said solution.

7. A method in accordance with claim 5 in which said bonding agent comprises from about 25% to about 50% by weight of said solution.

8. A method in accordance with claim 5 in which said solvent is a diisocyanate curative.

9. A method in accordance with claim 5 in which said solvent is a polar organic solvent.

10. A method in accordance with claim 1 in which said oxidizer is comprised of a combination of a first substance which produces HCl upon combustion and a second substance having as a combustion product a compound capable of neutralizing HCl.

11. A method in accordance with claim 10 in which said first substance is ammonium perchlorate and said second substance is sodium nitrate.

12. A method in accordance with claim 1 in which said curative is a diisocyanate curative, and said slurry comprises:

(i) about 15% to about 25% of said fuel;

(ii) about 25% to about 75% of said oxidizer;

(iii) about 4% to about 25% of said prepolymer;

(iv) about 0.1% to about 1.0% of said bonding agent; and (v) about 0.4 to about 2.0% of said diisocyanate curative.

13. A method in accordance with claim 1 in which said curative is a diisocyanate curative, said oxidizer is comprised of a combination of a first substance which produces HCl upon combustion and a second substance having as a combustion product a compound capable of neutralizing HCl, and said slurry comprises:

(i) about 15% to about 25% of said fuel;

(ii) about 35% to about 45% of said first substance;

(iii) about 25% to about 35% of said second substance;

(iv) about 4% to about 25% of said prepolymer;

(v) about 0.1% to about 1.0% of said bonding agent; and (vi) about 0.4% to about 2.0% of said diisocyanate curative.

14. A method in accordance with claim 1 in which said bonding agent is a compound having the formula

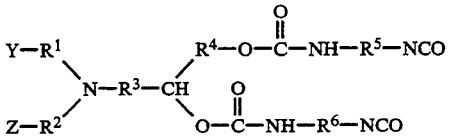

in which:

Y and Z independently are polar moieties each of dipole moment of at least about 2.0 debye units;

$R^1$, $R^2$, $R^3$ and $R^4$ independently are $C_1$–$C_6$ alkyl; and $R^5$ and $R^6$ are independently selected from the group consisting of divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-cyclohexanebismethyl, and nitrazapentane.

15. A method in accordance with claim 14 in which Y and Z are each cyano.

16. A method in accordance with claim 14 in which $R^1$, $R^2$, $R^3$ and $R^4$ independently are $C_1$–$C_3$ alkyl.

17. A method in accordance with claim 14 in which $R^5$ and $R^6$ are independently selected from the group consisting of divalent radicals of toluene, isophorone, and nitrazapentane.

18. A method in accordance with claim 14 in which $R^1$, $R^2$ and $R^3$ are each —$CH_2CH_2$—, and $R^4$ is —$CH_2$—.

19. A method in accordance with claim 14 in which Y and Z are each cyano; $R^1$, $R^2$ and $R^3$are each —$CH_2CH_2$—; $R^4$ is —$CH_2$—; and $R^5$ and $R^6$ are independently selected from the group consisting of divalent radicals of toluene, isophorone, and nitrazapentane.

20. A method in accordance with claim 1 in which said bonding agent is a compound having the formula

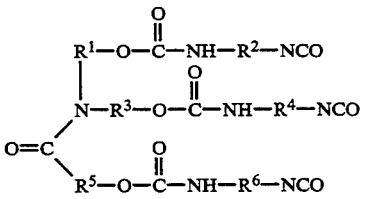

in which:

$R^1$, $R^3$ and $R^5$ are independently $C_1$–$C_6$ alkylene; and $R^2$, $R^4$, and $R^6$ are independently selected from the group consisting of divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-cyclohexanebismethyl, and nitrazapentane.

21. A method in accordance with claim 20 in which $R^2$, $R^4$, and $R^6$ are independently selected from the group consisting of divalent radicals of toluene, isophorone, and nitrazapentane.

22. A method in accordance with claim 20 in which $R^1$, $R^3$ and $R^5$ are independently $C_1$–$C_3$ alkylene.

23. A method in accordance with claim 20 in which $R^1$ and $R^3$ are each —$CH_2CH_2$—.

24. A method in accordance with claim 20 in which $R^1$ and $R^3$ are each —$CH_2CH_2$—, and $R^5$ is a member selected from the group consisting of —$CH_2$— and —$CH(CH_3)$—.

25. A method in accordance with claim 20 in which $R^1$ and $R^3$ are each —$CH_2CH_2$—, $R^5$ is a member selected from the group consisting of —$CH_2$— and —$CH(CH_3)$—, and $R^2$, $R^4$, and $R^6$ are independently selected from the group consisting of divalent radicals of toluene, isophorone, and nitrazapentane.

26. A method in accordance with claim 20 in which $R^1$ and $R^3$ are each —$CH_2CH_2$—, $R^5$ is —$CH_2$—, and $R^2$, $R^4$, and $R^6$ are each a divalent radical of isophorone.

27. A method in accordance with claim 20 in which $R^1$ and $R^3$ are each —$CH_2CH_2$—, $R^5$ is —$CH(CH_3)$—, and $R^2$, $R^4$, and $R^6$ are each a divalent radical of isophorone.

28. A method in accordance with claim 1 in which said bonding agent is a compound having the formula

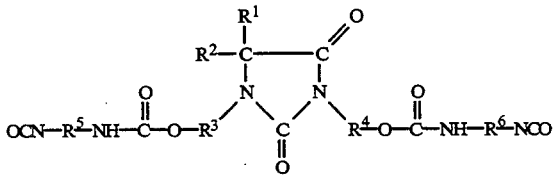

in which:

$R^1$ and $R^2$ independently are $C_1$–$C_6$ alkyl;

$R^3$ and $R^4$ independently are $C_1$–$C_6$ alkylene; and $R^5$ and $R^6$ are independently selected from the group consisting of divalent radicals of toluene, isophorone, methylbenzene, diphenylmethane, 1,5-naphthalene, bitolyl, m-xylene, n-hexane, trimethylhexane, tetramethylhexane, cyclohexane, 1,4-cyclohexanebismethyl, 1,3-cyclohexanebismethyl, and nitrazapentane.

29. A method in accordance with claim 28 in which $R^1$ and $R^2$ independently are $C_1$–$C_3$ alkyl.

30. A method in accordance with claim 28 in which $R^3$ and $R^4$ independently are $C_1$–$C_3$ alkylene.

31. A method in accordance with claim 28 in which $R^5$ and $R^6$ are independently selected from the group consisting of divalent radicals of toluene, isophorone, and nitrazapentane.

32. A method in accordance with claim 28 in which $R^1$ and $R^2$ independently are $C_1$–$C_3$ alkyl; $R^3$ and $R^4$ independently are $C_1$–$C_3$ alkylene; and $R^5$ and $R^6$ are independently selected from the group consisting of divalent radicals of toluene, isophorone, and nitrazapentane.

33. A method in accordance with claim 28 in which $R^1$ and $R^2$ are each methyl; $R^3$ and $R^4$ are each —CH2CH$_2$13; and $R^5$ and $R^6$ are each a divalent radical of isophorone.

* * * * *